US009745170B2

(12) United States Patent
Roussel

(10) Patent No.: US 9,745,170 B2
(45) Date of Patent: Aug. 29, 2017

(54) METHOD FOR OPERATING AN ELEVATOR CONTROL SYSTEM

(71) Applicant: Inventio AG, Hergiswil (CH)

(72) Inventor: Frank Olivier Roussel, Lucerne (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 15/038,103

(22) PCT Filed: Nov. 13, 2014

(86) PCT No.: PCT/EP2014/074545

§ 371 (c)(1),
(2) Date: May 20, 2016

(87) PCT Pub. No.: WO2015/074958

PCT Pub. Date: May 28, 2015

(65) Prior Publication Data

US 2016/0280508 A1 Sep. 29, 2016

(30) Foreign Application Priority Data

Nov. 21, 2013 (EP) ..... 13193861

(51) Int. Cl.

| | |
|---|---|
| ***B66B 5/00*** | (2006.01) |
| ***B66B 1/40*** | (2006.01) |
| ***B66B 1/36*** | (2006.01) |

(52) U.S. Cl.

CPC ..... *B66B 5/0025* (2013.01); *B66B 1/36* (2013.01); *B66B 1/40* (2013.01); *B66B 5/0018* (2013.01); *B66B 5/0037* (2013.01)

(58) Field of Classification Search

CPC ... B66B 5/0025; B66B 5/0018; B66B 5/0037; B66B 1/36

(Continued)

(56) References Cited

U.S. PATENT DOCUMENTS 4,629,034 A * 12/1986 Inaba ..... B66B 1/40 187/293
4,691,807 A * 9/1987 Iwata ..... B66B 1/285 187/294

(Continued)

FOREIGN PATENT DOCUMENTS

| | | |
|---|---|---|
| EP | 0483560 B1 | 8/1995 |
| EP | 0776855 A1 | 6/1997 |
| WO | 2012032020 A1 | 3/2012 |

*Primary Examiner* — David Warren

(74) *Attorney, Agent, or Firm* — Shumaker, Loop & Kendrick, LLP; William J. Clemens

(57) ABSTRACT

A method for operating an elevator control system for controlling and monitoring the movements of at least one elevator car when the elevator car approaches individual floors in a building, and in the process stops at a respective floor in a prescribed stopping position, the method including, in conjunction with a floor stop, determining an overall error in the form of a deviation between an actual position of the elevator car and a position of the elevator car assumed as the current position. The elevator control system generates service signals based on a statistical acquisition of several values for the overall error, and/or wherein the overall error is used to ascertain a derivative value, which is taken into account along with the current or stopping position during a comparison between the current position and stopping position performed by the elevator control system for approaching the respective stopping position.

9 Claims, 6 Drawing Sheets

(58) Field of Classification Search
USPC ..... 187/393
See application file for complete search history.

(56) References Cited

U.S. PATENT DOCUMENTS

| | | | | |
|---|---|---|---|---|
| 5,054,585 | A * | 10/1991 | Amano | B66B 1/2408 187/382 |
| 5,313,026 | A * | 5/1994 | Youla | B66B 1/3492 187/394 |
| 5,435,416 | A * | 7/1995 | Siikonen | B66B 1/3484 187/392 |
| 2003/0192746 | A1* | 10/2003 | Suzuki | B66B 5/0037 187/391 |
| 2005/0230192 | A1 | 10/2005 | Brant | |
| 2009/0050417 | A1* | 2/2009 | de Groot | B66B 1/2458 187/387 |
| 2012/0055742 | A1* | 3/2012 | Takeda | B66B 1/2458 187/382 |
| 2012/0090922 | A1* | 4/2012 | Elomaa | B66B 1/2458 187/247 |
| 2013/0206517 | A1* | 8/2013 | De Jong | B66B 1/2458 187/381 |
| 2015/0129367 | A1* | 5/2015 | Tyni | B66B 3/00 187/393 |
| 2015/0314983 | A1* | 11/2015 | Saari | B66B 1/468 187/382 |
| 2016/0031676 | A1* | 2/2016 | Haipus | B66B 1/468 187/247 |
| 2016/0280508 | A1* | 9/2016 | Roussel | B66B 1/40 |
| 2016/0289041 | A1* | 10/2016 | Schatt | B66B 1/3492 |

* cited by examiner

METHOD FOR OPERATING AN ELEVATOR CONTROL SYSTEM

FIELD

The invention relates first and foremost to a method for operating an elevator control system. In addition, the invention also relates to a computer program for implementing the method, as well as to a computer program product with such a computer program and a device, for example specifically an elevator control system, with such a computer program as a means for implementing the method.

BACKGROUND

Known in the art is to operate an elevator system by means of an elevator control system and at least one drive actuated by the elevator control system for moving at least one elevator car. The elevator control system controls the movement of at least one elevator car in at least one elevator car shaft. The or each elevator car—the description below will be continued based on one elevator car, without ruling out a more expansive general validity—approaches individual floors under the control of the elevator control system, and in the process stops at a respective floor in a prescribed stopping position. The prescribed stopping positions are derived based on the number of floors linked by the elevator car shaft, and based on a lower edge of the individual floor doors. A stopping position is then the position of the elevator car in the elevator car shaft in which the one lower edge of the floor door and a lower edge of the car door align, or at least essentially align.

The drive controlled by the elevator control system for moving the elevator car is usually a drive in the form of a converter fed by a supply network with an electric motor downstream from the converter. By actuating the motor-side portion of the converter (inverter) in a manner basically known in the art, the electrical power that gets to the electric motor is influenced in terms of frequency and amplitude, so that in particular the speed of the electric motor, and hence the resultant speed at which the elevator car moves in the elevator car shaft, can be influenced and prescribed by means of the elevator control system.

For purposes of the floor stop mentioned above, position information referred to below as the current position can be compared with a stopping position prescribed for the floor stop. The elevator control system receives the position information used as the current position from the drive. For example, data about the speed and rotational position of the drive are here involved. In a manner known in the art, electric drives make such data accessible for retrieval by an external controller, i.e., the elevator control system in this case. If the current position and stopping position coincide within prescribed limits, the stopping position has been reached. The elevator car is then in a position where the car doors can be opened for the respective floor, so as to allow passengers to exit or waiting passengers to enter. However, the desired stopping position can in practice not always be approached with the actually desired accuracy, which is termed landing precision in specialized terminology.

SUMMARY

Proceeding from this situation, an object of the invention is to indicate a method for operating an elevator control system provided for controlling and monitoring the movement of at least one elevator car, which makes it possible to improve accuracy when approaching a respective stopping position during a floor stop and/or subsequently recognize the landing precision for floor stops that have already taken place.

According to the invention, this object is achieved with a method for operating an elevator control system provided for controlling and monitoring the movement of at least one elevator car as follows:

The elevator car approaches individual floors in a building in basically a known manner under the control of the elevator control system, and in the process stops at a respective floor in a prescribed stopping position.

In conjunction with a floor stop, an overall error is determined in the form of a deviation between an actual position of the elevator car and a position of the elevator car assumed as the current position. The position assumed as the current position—hereinafter current position for short—is ascertained based on drive data for the elevator car, i.e., based on data that can be derived as the speed, angular position and the like from a drive and/or converter actuated by means of the elevator control system. However, let it be emphasized that the current position managed by the elevator control system is an assumed position. The overall error expresses a deviation between this current position and the actual position. This overall error can be statistically evaluated to check whether floor stops are properly taking place, and the respective stopping positions are being approached with the actually desired landing precision. Additionally or alternatively, the overall error is used to determine a derivative value. In the simplest case, the derivative value corresponds to the underlying overall error. This derivative value is taken into account in addition to the current position or stopping position during an ensuing comparison between the current position and stopping position performed by the elevator control system for approaching the respective stopping position.

Therefore, the advantage to the approach described here and below is that the ascertained overall error can be used to obtain evidence about the landing precision with which a stopping position is being approached, and/or that the stopping position can be approached more precisely by taking into account an error that had arisen while previously approaching the stopping position in the form of a derived value. In a particularly simple situation, then, the drive for moving the elevator car is stopped while considering the derivative value not just when the respective current position and stopping position coincide within prescribed limits, but also already when the current position lies within a range defined by the derivative value around the stopping position. Evidence about the landing precision with which a stopping position is being approached made possible by ascertaining an overall error or several overall errors can be used as proof of compliance with the standard as relates to the landing precision of the elevator car. A service technician who checks the elevator system and proper function as part of customary service intervals then no longer has to check the landing precision him or herself, and can rather draw upon data about landing precision recorded by the elevator control system during operation. Such data can be used to easily determine whether the landing precision achieved during operation was observed within the tolerance prescribed by the standard. Such data can also be retrieved by a service technician without having to travel to the site of the respective elevator system, so that compliance with landing precision can also be checked via "remote monitoring" (e-inspection).

In a special embodiment of the method outlined above, a derivative value ascertained based on the respective overall error is used for each floor of a building. This makes it possible to consider dynamic influences on the movement of the elevator car in the elevator car shaft. As may here be exemplarily pointed out, it must be assumed that the free length of the suspension ropes and a possible dynamic change in length (lengthening or shortening) depending thereon will influence the respective precision with which the stopping position can be approached. Because the influences are correlated with the free length of the suspension ropes, and hence with the respectively corresponding floor, such influences are comparatively easy to consider if, for each floor of the respective building or at least individual floors of the building, use is made of a derivative value ascertained for the latter based on the overall error, i.e., of a floor-specific derivative value.

In another embodiment of the method, at least two derivative values ascertained based on the respective overall error are used for at least individual floors of a building, for example not the bottom floor and/or not the top floor. These at least two derivative values are a first floor-specific derivative value for upward movement prior to the floor stop, as well as a second floor-specific derivative value for downward movement prior to the floor stop. This makes it possible to consider influences, for example those depending on mass acceleration, inertia and gravitation. It can generally be expected that a different overall error will result during a floor stop following an upward movement than after a preceding downward movement. Because the method considers varying derivative values as a function of the preceding direction of movement, this can be taken into account.

In a special embodiment of this configuration of the method, at least four derivative values ascertained based on the respective overall error are used for at least several floors. These at least four derivative values include a first floor-specific derivative value for an upward movement prior to the floor stop and an upward movement after the floor stop, a second floor-specific derivative value for a downward movement prior to the floor stop and a downward movement after the floor stop, a third floor-specific derivative value for an upward movement prior to the floor stop and a downward movement after the floor stop, as well as a fourth floor-specific derivative value for a downward movement prior to the floor stop and an upward movement after the floor stop. These varying derivative values take into account the possible moving situation of the elevator car, meaning the direction in which the position of the floor stop is reached, and in which direction the movement continues.

The aforementioned object is also achieved with an elevator control system designed for implementing the method and several or all configurations of the method. The invention is here preferably implemented with software. As a consequence, the invention is on the one hand also a computer program with program code instructions executable by a computer, specifically the elevator control system, as well as a storage medium with this kind of computer program, i.e., a computer program product with program code means, and finally also an elevator control system, the memory of which is loaded or can be loaded with such a computer program as means for implementing the method and its configurations. The method described here and below is automatically implemented by the elevator control system, wherein the elevator control system controls the elevator so that the latter approaches individual floors in a building, and thereby executes a respective floor stop at a prescribed stopping position. In conjunction with a floor stop, an overall error is ascertained in the form of a deviation from an actual position of the elevator car and a position of the elevator car assumed as the current position. A derivative value is ascertained based on the overall error. The latter is taken into account along with the current or stopping position during a comparison between the current position and stopping position performed by the elevator control system for approaching the respective stopping position.

Unless otherwise expressly indicated in the text, each described procedural step must be interpreted as being automatically implemented by the elevator control system based upon and under the control of a respective control program executed by the latter.

An exemplary embodiment of the invention will be explained in more detail below based on the drawings. Corresponding objects or elements on all figures are provided with the same reference numbers.

The or each exemplary embodiment is not to be understood as limiting the invention. Rather, changes and modifications are also possible within the framework of the present disclosure, for example which can be derived by the expert so as to achieve the objective by combining or modifying individual features or elements or procedural steps described in conjunction with the general or special part of the specification and contained in the claims and/or drawing, and lead to a new object or new procedural steps or sequences of procedural steps via combinable features.

DESCRIPTION OF THE DRAWINGS

Shown on.

DETAILED DESCRIPTION

Figure 1:
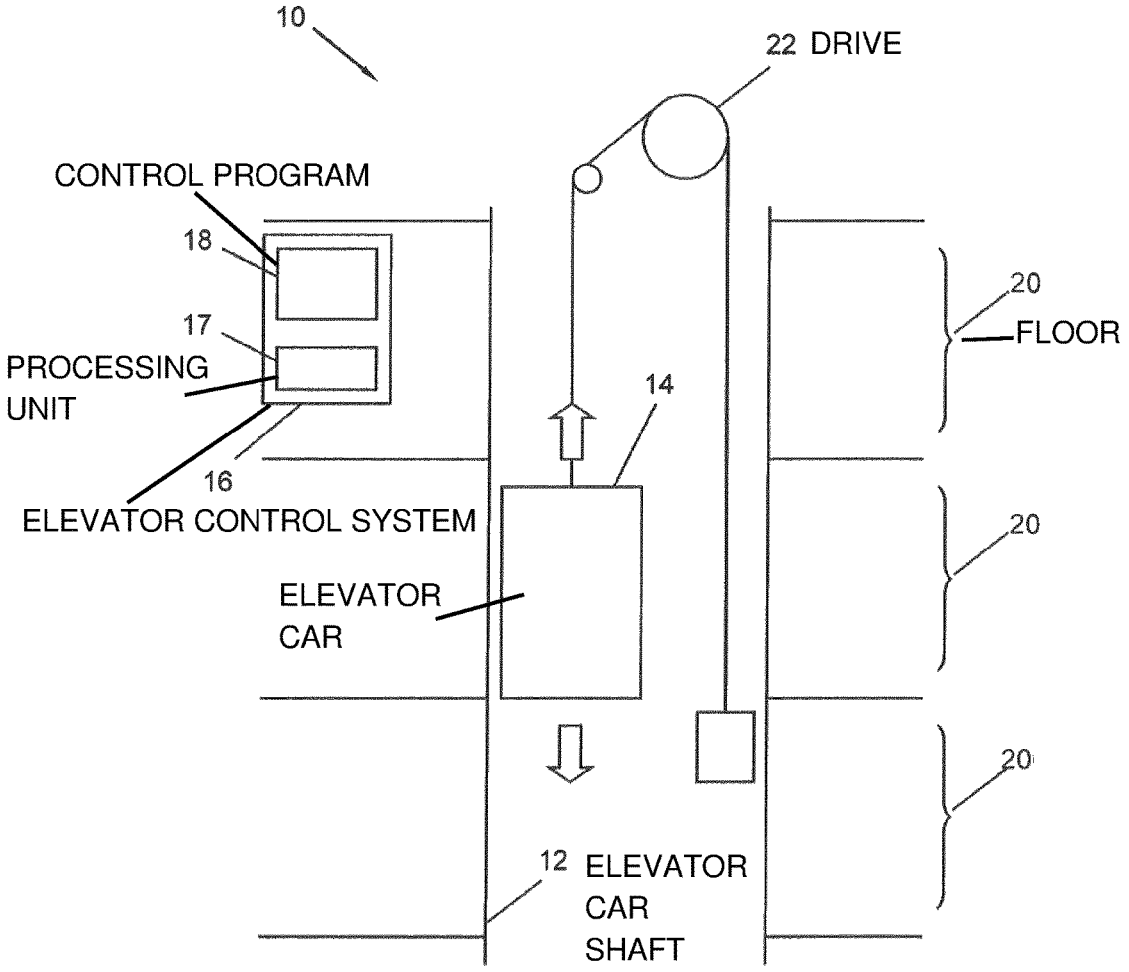
Fig. 1 (PRIOR ART)
FIG. 1 is schematic diagram of an elevator system with an elevator control system with an elevator car according to the prior art.

The illustration on FIG. 1 presents a schematically simplified depiction of an elevator system 10 in a building (not itself shown) with at least one elevator car 14 movable in at least one elevator car shaft 12 and an elevator control system 16 provided at a central location of the building. The elevator control system 16 is provided in a known manner for controlling the elevator system 10. To this end, the elevator control system 16 encompasses a processing unit 17 in the form or type of a microprocessor, as well as a control program 18 in a memory (not itself shown) that determines the functionality of the elevator control system 16.

The or each elevator car 14 can move in the elevator car shaft 12 or a respective elevator car shaft in a manner known in the art, so that varying floors 20 of the building can be reached. In a manner basically known in the art, the elevator control system 16 to this end actuates a drive 22 in the form of an electric motor, usually in the form of a combination of an electric motor and a converter. Also present but not shown are the following elements: Car doors of the elevator car 14, floor doors on each floor 20, control elements in the elevator car 14 for a car call and operating elements on the individual floors 20 for a floor call. Likewise not shown but of course present are hard-wired or wireless connections between the individual units of the elevator system 10 for transmitting signals, data and electrical power.

The mentioned car or floor calls are processed by the elevator control system 16 in a manner known in the art, for example resulting in the elevator car 14 moving from a first floor 20 to a second floor 20. To initiate such a movement, the elevator control system 16 actuates the drive 22 accordingly, and the movement ends when the elevator car reaches a stopping position known in relation to the respective destination floor. Such stopping positions are expressed in the form of numerical values and, for example because they are derived from a fixed position of a lower edge of a respective floor door, prescribed to the elevator control system 16 as constant values.

Expressed in simplified terms, when the elevator control system 16 moves the elevator car and based on an actuation of the drive 22 by the elevator control system 16, a check is performed to determine whether a destination position belonging to the respective floor or car call, i.e., the stopping position ("landing position") of the floor 20 selected with the floor or car call, has been reached. To this end, the respective holding position is continuously or at equidistant times—both referred to below as continuously for short—compared with position information that is referred to below as the current position of the elevator car 14, or current position for short, which the elevator control system retrieves at the drive 22, for example, or creates itself based on data provided by the drive 22.

Figure 2:
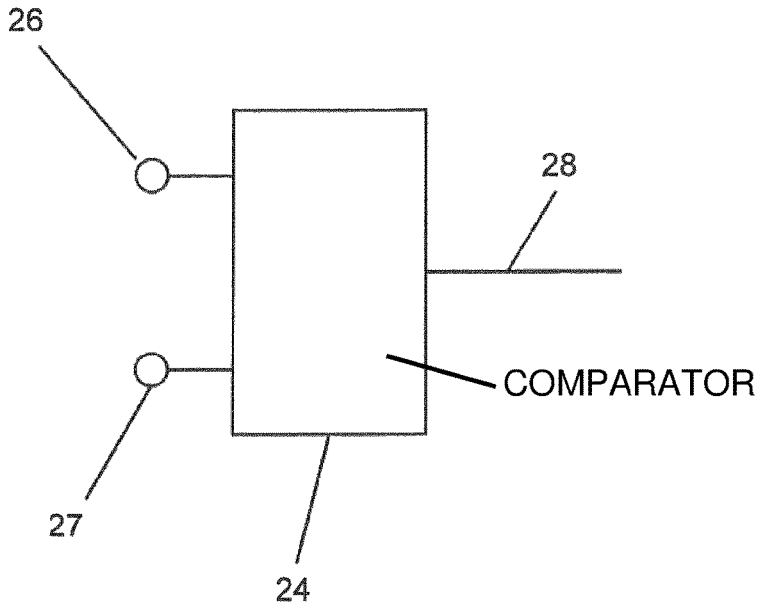
Fig. 2 (PRIOR ART)
FIG. 2 is a schematic diagram of a prior art comparator.

To this end, the illustration on FIG. 2 depicts a known comparator 24 with two inputs 26, 27 for comparing the input signals supplied there, and for generating an output signal 28 as a function of the result of the comparison. The comparator 24 is provided with the respective current position at its first input 26, and with the respective stopping position at its second input 27. The comparator 24 compares the values supplied at the two inputs 26, 27, and, given an equality or sufficient equality, generates an output signal 28, for example which can be used to stop the drive 22 under the control of the elevator control system 16. Of course, the illustration on FIG. 2 is only an example, and the respective current position can likewise also be compared with the stopping position by means of a comparator implemented in software as the functionality in the respective control program 18 executed by the elevator control system 16.

Such a comparison between the respective current position and the respective stopping position proceeds from ideal conditions, which are not always on hand in practice. This will be explained based on the following FIG. 3.

Figure 3:
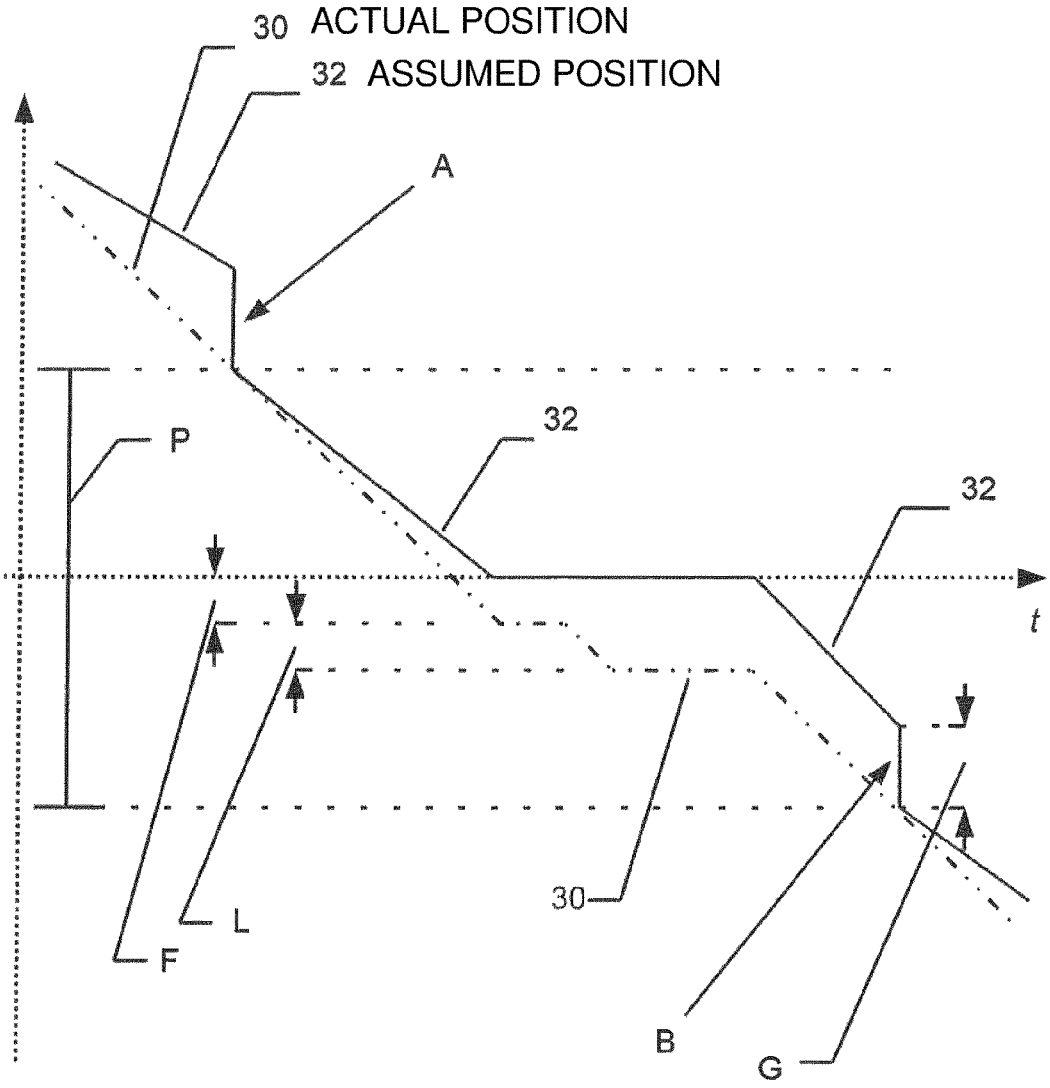
FIG. 3 is a chronological progression of values describing a movement by the elevator.

The illustration on FIG. 3 shows two curves 30, 32, specifically a first curve 30 and a second curve 32, for moving an elevator car 14 before and after a floor stop. The first curve 30 represents the actual position of the elevator car 14, and is labeled accordingly below. The second curve 32 represents an assumed position of the elevator car 14 based on drive data, in particular converter data. The position of the elevator car 14 assumed based on drive data is the already mentioned current position, since only this position is known to the elevator control system 16, and is correspondingly assumed to be the current position by the elevator control system 16.

Provided for each floor 20 is a position indicator referred to in specialized terminology as a floor flag, which defines the stopping position provided for the respective floor 20. For example, such a position indicator involves a forked photoelectric sensor, which works in conjunction with a switch flag that dips into the slit of the forked photoelectric sensor, as described in EP 0 483 560 B. The measuring range acquired by the position indicator is marked "P" in the illustration on FIG. 3, and in the interest of easy legibility will itself also be labeled as position indicator P.

In the illustration on FIG. 3, the abscissa on which time t is recorded coincides with the stopping position. Actual or assumed positions of the elevator car 14 before the floor stop are plotted on curves 30, 32 above the abscissa/stopping position. Positions after the floor stop are correspondingly plotted below the abscissa/stopping position.

As the elevator car 14 approaches the provided stopping position, it reaches the position indicator P at a specific point in time. It is here possible for the elevator control system 16 to correct the assumed current position 32 of the elevator car 14 based on the drive data, because the location of the position indicator P is known. In the situation exemplarily shown on FIG. 3, for example, this takes place prior to the floor stop at the position marked "A", and after the floor stop at the position marked "B".

The floor stop takes place even after such a correction based on the current position assumed and potentially corrected based on the drive data. Nevertheless, an actual stopping position resulting from a comparison of the kind described on FIG. 2 can deviate from the respectively provided stopping position, and this is recorded as position error "F" on FIG. 3. In conjunction with the floor stop, there is usually a change in the overall weight of the elevator car 14 as persons get on or off and/or objects get loaded and unloaded. Referred to below as a load change, this change in the overall weight of the elevator car 14 also influences the actual stopping position of the elevator car 14 relative to the provided stopping position. This is recorded in the illustration on FIG. 3 as load change "L". When the elevator car 14 starts moving again after the floor stop, and again passes the position indicator P or at least an edge of the position indicator P, there is once again a possibility to correct the current position assumed based on the drive data, specifically based on the known position of the position indicator P. The correction that here takes place is recorded as the overall error "G" in the illustration on FIG. 3.

Only the overall error G along with a possible change in car weight can be quantitatively acquired in conjunction with a floor stop. The respectively acquired overall error is to be used to statistically evaluate the landing precision of the elevator car 14. A statistical evaluation can relate to the respective last trip, the last x trips, e.g., the last ten trips, the trips on the current day, the trips on the preceding day, the trips in the current or pre-ceding week, in the current or preceding month, etc. The landing precision is here the accuracy with which the elevator car 14 reaches the stopping position/landing position during the floor stop. Additionally or alternatively, the respectively acquired overall error G and also the known change in car weight can be used in an attempt to reach the provided stopping position as precisely as possible and minimize the positioning error F while approaching the same floor 20 the next time.

Initially assuming for simple conditions that the car weight does not change during a floor stop, the overall error G when leaving the position indicator P can be assumed as a gauge for the positioning error F during the preceding floor stop. Therefore, the elevator control system 16 can take into account a derivative value derived from the overall error G in addition to the current position assumed based on the drive data.

Figure 4:
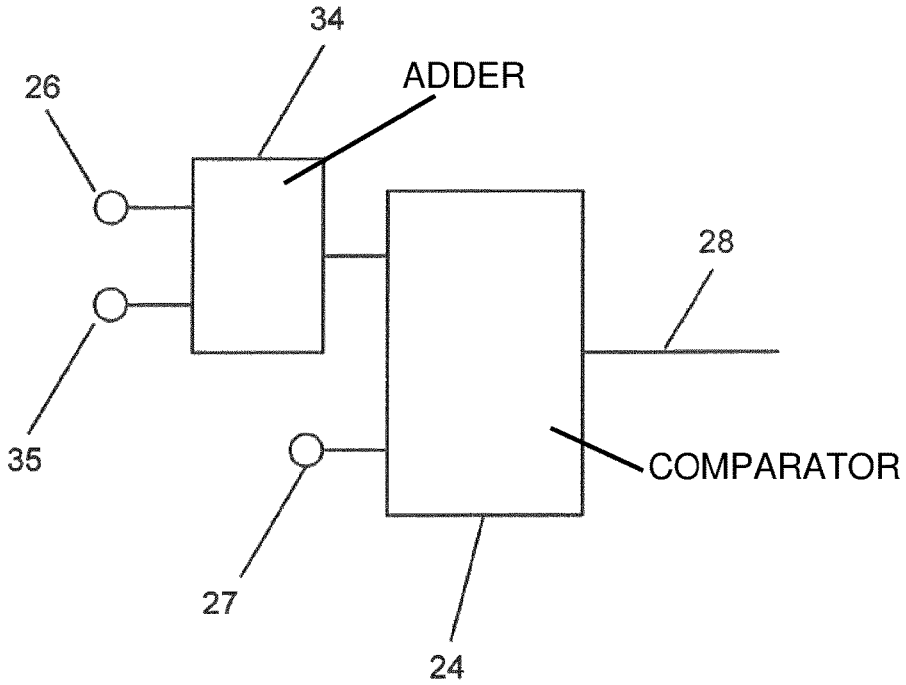
FIG. 4 is a comparator as in FIG. 2 with an upstream adder according to the invention.

For purposes of explanation, reference is to this end made to the illustration on FIG. 4, which just as the illustration on FIG. 2 depicts a comparator 24, which given a sufficient equality of the respectively supplied variables generates an output signal 28 that can be used to stop the drive 22. As opposed to the illustration on FIG. 2, an adder 34 is connected upstream from the comparator 24. The adder 34 encompasses a first input 26 and second input 35. The adder 34 is provided with the respective current position of the elevator car 14 at the first input 26, and with the derivative value formed based on the overall error G at the second input 35. The comparator 24 itself is provided with the sum formed in this way and with the stopping position supplied to its second input 27. As a consequence, the output signal 28 is generated when the sum of the respective current position and respective derivative value coincide or sufficiently coincide with the stopping position. It here again holds true that the illustration on FIG. 4 is of course just an example, and the comparison can similarly be performed with a software-implemented comparator.

Whether a sum or difference of the current position and derivative value is formed in practice depends on the type of derivative value formed and the respective direction of the elevator car 14. In addition, the derivative value can similarly be considered in the form of a sum or difference with the stopping position.

Returning to the situation depicted on FIG. 3, the overall error G that results when leaving the position indicator P means that the elevator car 14 has actually "traveled further" than assumed by the elevator control system 16 based on the respective current position. Briefly stated, in order to compensate for the above, the elevator car 14 must stop "earlier" at this floor 20, so that given a repeated erroneous positioning that led to the previously acquired overall error G, the earlier stop compensates or at least partially compensates for the erroneous positioning that is never entirely avoidable. This is accomplished while approaching the respective stopping position during a comparison performed by the elevator control system 16 between the current position and stopping position by taking into account the derivative value in addition to the current or stopping position, e.g., as may be done with a comparator 24 wired as depicted on FIG. 4 or correspondingly realized software.

Practical tests with the previously described approach have shown that varying overall errors G arise for varying floors 20. As a consequence, a special embodiment of the previously described method provides that respective floor-specific derivative values be formed based on floor-specifically ascertained overall errors G instead of on a derivative value ascertained based on an overall error G. Such floor-specific derivative values are processed based on the already described processing approach for each floor 20. Therefore, while approaching the respective stopping position during a comparison performed by the elevator control system 16 between the current position and stopping position, the floor-specific derivative value is taken into account in addition to the current or stopping position.

Figure 5:
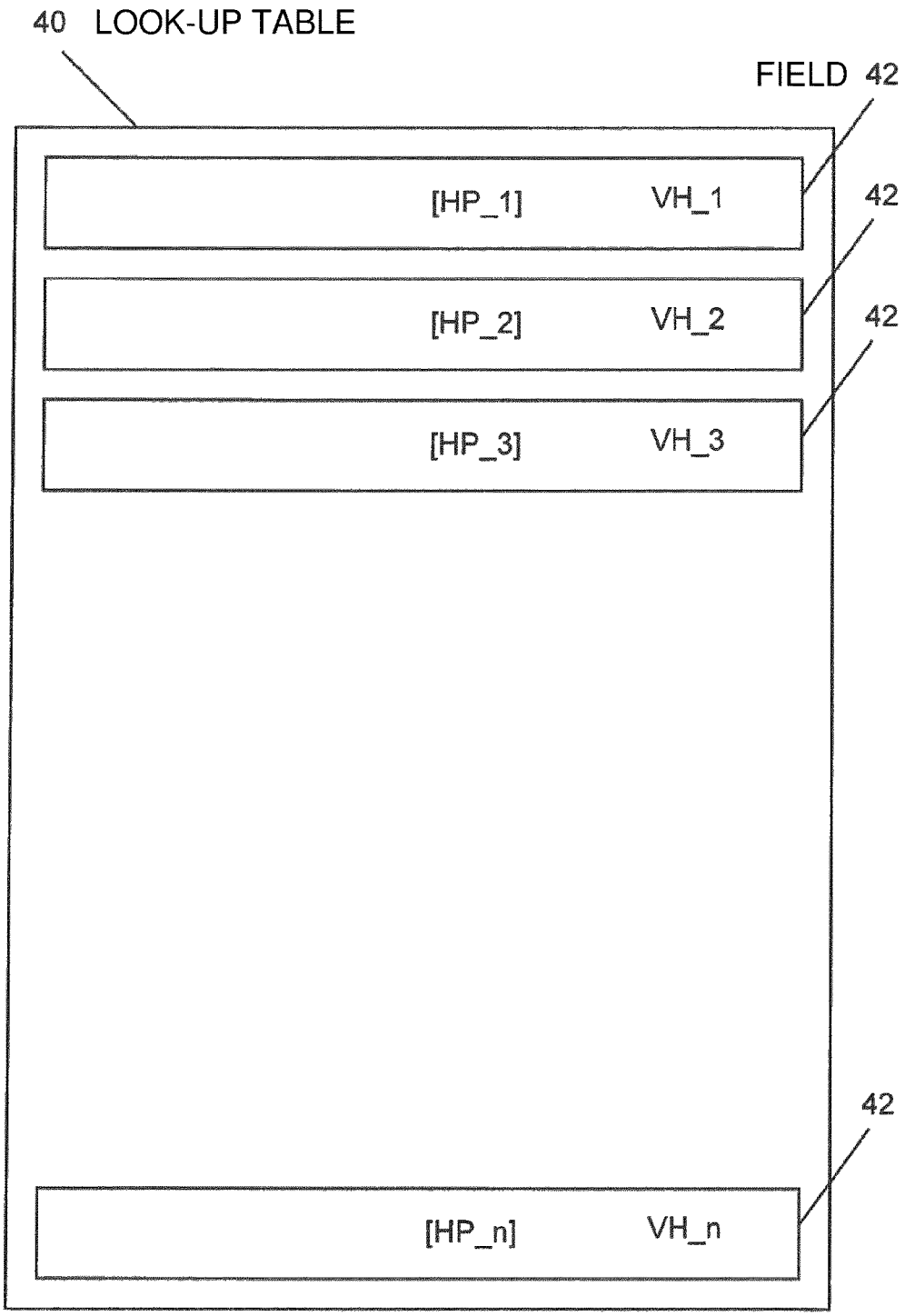
FIG. 5 to FIG. 7 are schematically simplified illustrations of so-called look-up tables used by the method according to the invention.

The respective floor-specific derivative value to be used can be selected by means of a so-called look-up table 40 (look-up table, LUT), as exemplarily shown in the illustration on FIG. 5. The look-up table 40 encompasses a number of fields 42 corresponding to the number of floors 20 in the respective building. Each field 42 encompasses a floor-specific derivative value, which are symbolically recorded in the illustration on FIG. 5 as VH_1, VH_2, VH_3 and VH_n. While approaching a specific floor 20 in response to car or floor call, the elevator control system 16 can then use a number of the respective floor 20 to access the look-up table 40, and once there select the field 42 corresponding to the number of the respective floor 20. This makes the specific derivative value accessible to the floor 20 to be approached, and the floor-specific derivative value retrieved in this way is further used as explained above.

It is here also possible in particular that a look-up table 40 used by the elevator control system 16 for managing floor-specific stopping positions be enhanced in such a way that this look-up table 40 encompasses both the floor-specific derivative values and the floor-specific stopping positions. In the illustration on FIG. 5, these are symbolically recorded as HP_1, HP_2, HP_3 and HP_n, wherein the basic optionality is denoted by the brackets.

Figure 6:
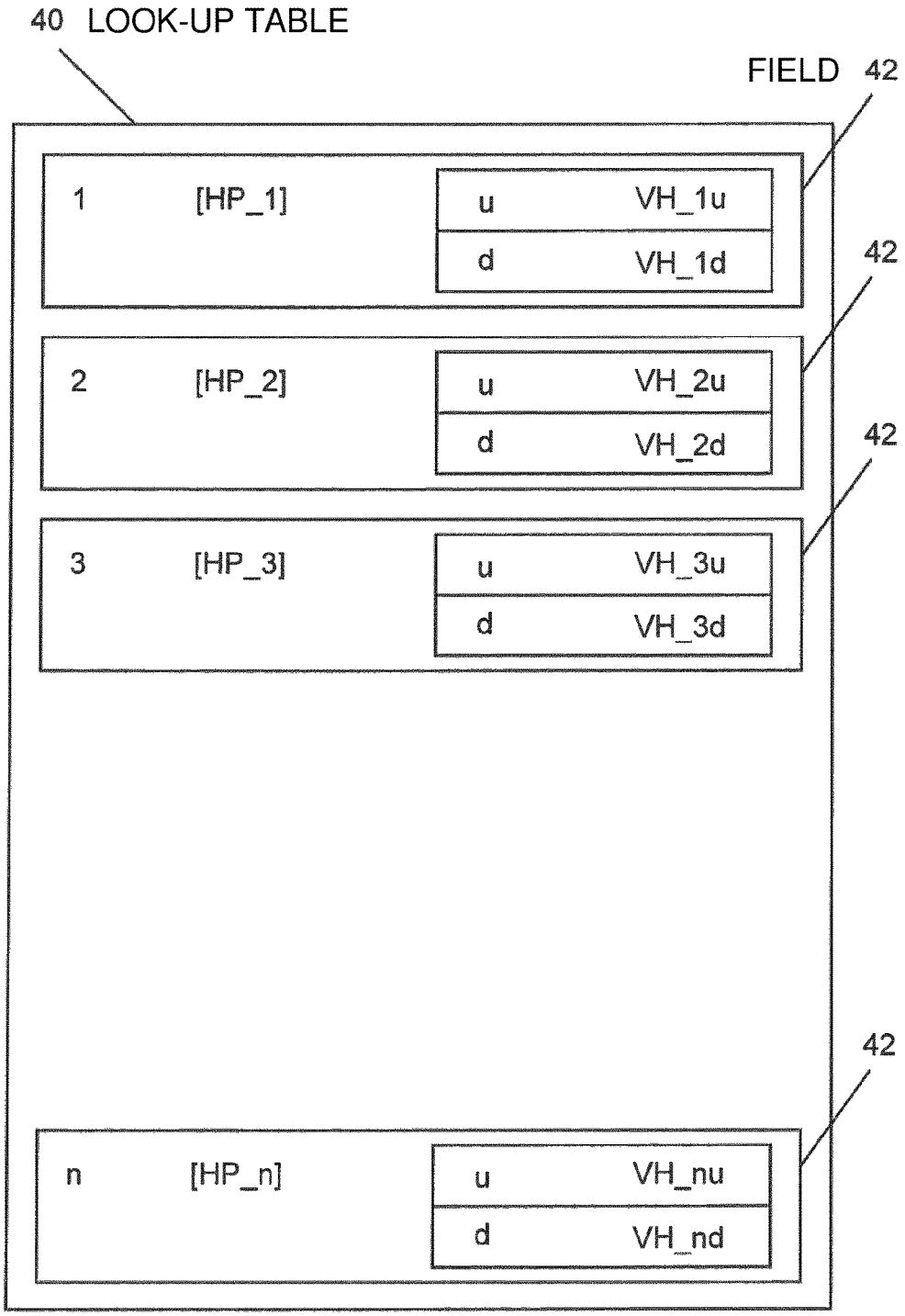

However, practical tests with the previously described approach have also demonstrated that the resulting overall error G also depends on the respective direction of the elevator car 14 apart from the respectively approached floor, and that direction-dependent derivative values can be used to further improve the precision upon reaching the respective stopping position. In a correspondingly enhanced method, respective overall errors G ascertained as a function of direction include the respective directionally dependent and floor-specific derivative values formed therefrom, which are symbolically recorded in a correspondingly enhanced look-up table 40 in the illustration on FIG. 6 as VH_1u, VH_1d, VH_2u, VH_2d, . . . , VH_nu, VH_nd. Each field 42 here to some extent encompasses a separate, small look-up table, and the value filed in its fields is used by the elevator control system 16 as a direction-dependent and floor-specific derivative value in the manner described above. The respective direction of movement is here symbolically marked with "u" (up) and "d" (down) for ease of differentiation.

Additional practical tests with the approach described to this point have demonstrated that, in addition to the respectively approached floor 20 and respective direction of the elevator car while approaching the floor 20, the resulting overall error also depends on which direction the trip continues in after the floor stop, and that the precision upon reaching the respective stopping position can be further improved yet again by providing derivative values that have been additionally further refined in this regard. The derivative values that are specific in this respect can also be comparatively easily organized in a look-up table 40, and accordingly are kept there so that they can be retrieved by the elevator control system 16.

Figure 7:
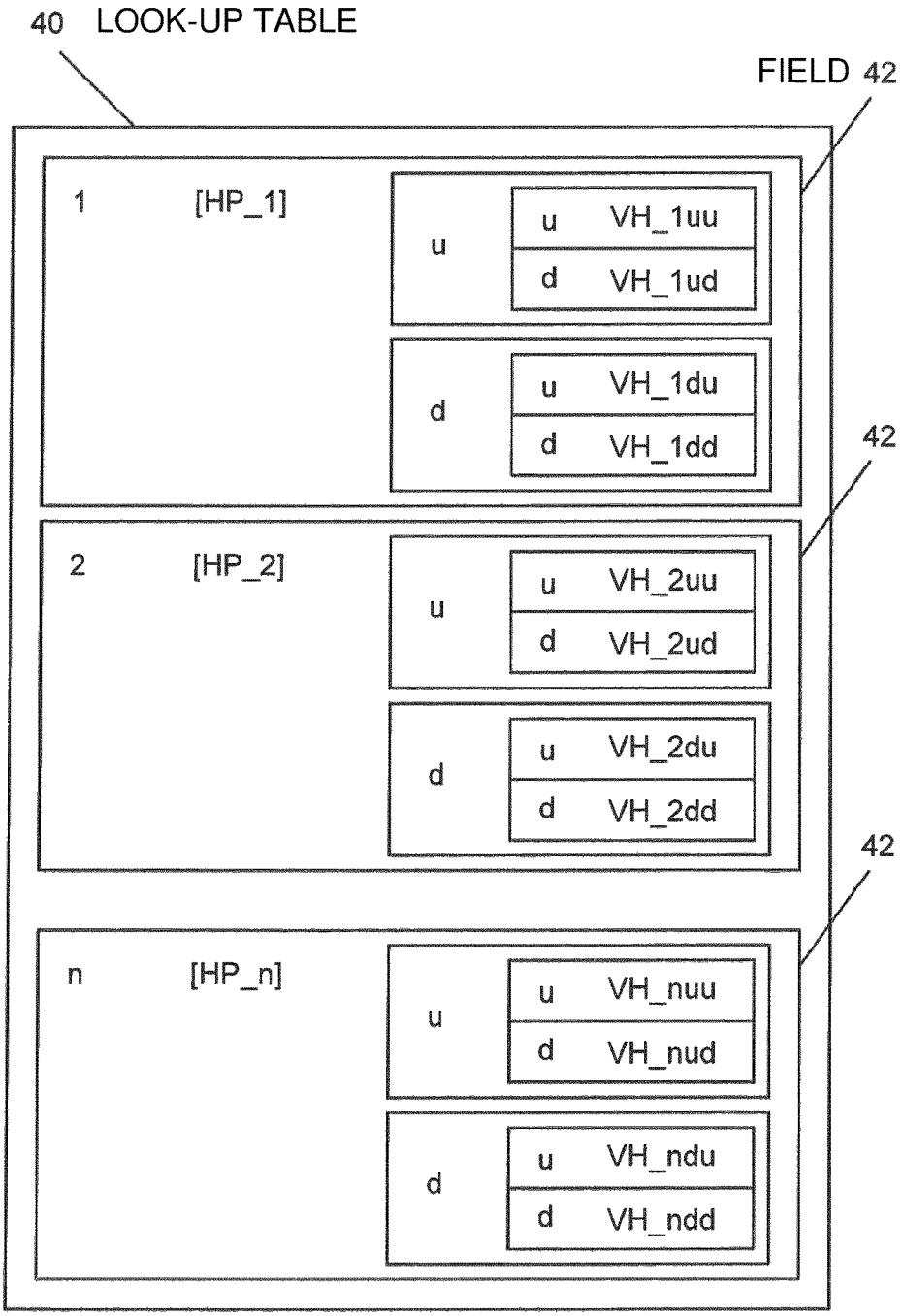

The illustration on FIG. 7 shows a corresponding look-up table 40. Its fields 42 encompass a separate, small look-up table for the direction of movement, and these fields in turn each encompass a separate, small look-up table for the direction in which the movement resumes after the floor stop. The resulting derivative values are recorded on FIG. 7 based on the already used scheme. When one of the values symbolically recorded therein is exemplary picked out, "VH_2ud" stands for the derivative value for a floor stop on the second floor 20 of the building while moving up toward the stopping position and moving down after the floor stop.

All of the above explanations relating to the acquisition of specific derivative values and their acquisition in a look-up table, for example, also apply correspondingly to a floor-specific and/or direction-specific acquisition of the overall error G underlying the derivative values and a generation of service signals by the elevator control system 16 based thereon. If at least one such acquisition of the overall error G takes place, a service technician can access the relatedly generated service signals, or the acquired overall error G itself, or statistical evaluations already initiated by the elevator control system 16, even in the form of a remote access (remote monitoring/e-inspection). For example, it can then be determined whether the landing precision has been violated, e.g., on specific floors or in specific directions, so that information can be derived therefrom for maintaining the elevator system.

Because the suspension ropes holding the elevator car 14 are elastic in terms of their material properties, a resultant positioning error F (FIG. 3) also stems in part from this elasticity. This can also be compensated with a look-up table (not shown). This is based on the assumption that, while passing the position indicator P, it can be expected that the acceleration of the elevator car 14 is constant and correspondingly that the tug is equal to zero. It is further assumed that the speed and acceleration of the drive 22 and resultant speed or acceleration of the elevator car 14 are identical. A comparatively simple movement equation, specifically $$M \times Ac = C \times Le \times E \text{ or } E = (M \times Ac)/(C \times Le),$$

wherein M stands for the mass and Ac for the acceleration of the elevator car 14, C for the material constant for the elasticity of the suspension rope or suspension ropes, and Le for the length of the suspension rope between the drive 22 and elevator car 14, can then be used to calculate the change in length (lengthening or shortening) of the suspension rope or suspension ropes marked E, hereinafter referred to separately and together as suspension rope, without ruling out a further general validity. The results of such a calculation can be recorded floor-specifically for the accompanying values of the parameter Le in a look-up table. In addition, the accompanying values for the change in length of the suspension rope can also be calculated in advance for one or more different values for the parameter M and recorded in the look-up table. The floor-specific values for the change in length of the suspension rope can be retrieved from the look-up table based on the respective destination floor selected via the car or floor call. The mass-specific values for the change in length of the suspension rope can be retrieved floor-specifically from the look-up table by acquiring the respective mass of the elevator car, and thus interpolating the values for the change in length of the suspension rope that can be retrieved from the look-up table.

If available, the values obtainable floor-specifically or floor-specifically and mass-specifically for an expected change in length of the suspension rope can be considered when determining the respective derivative value, for example by subtracting the value for the expected change in length of the suspension rope from the derivative value.

The above assumption of a constant acceleration of the elevator car 14 as it passes the position indicator P is normally justified in the case of the movement profiles for a so-called "position trip" (movement profiles of the kind described in WO 2012/032020 A) used by the respective elevator control system 16 while the elevator car 14 moves between the floors 20. Such movement profiles are characterized by the fact that acceleration first increases, then remains constant and finally approaches zero once the nominal speed has been reached. Such movement profiles can be prescribed in a known manner to the respective converter actuated by the respective elevator control system 16, or be filed in the converter itself. In such a movement profile, the force acting on the suspension rope and the resultant change in length can be ascertained particularly easily without having to know the dynamic behavior of the suspension rope in detail. The respective change in length can basically also be ascertained based on a non-constant acceleration.

Because car trips take place in practice with varying loads on the elevator car 14, the respective overall error G (FIG. 3) also depends on the load, and above all on a load change. As a consequence, varying overall errors G and respectively varying derivative values arise during different trips to the same floor 20, depending on the load and load change. This is taken into account by acquiring statistics regarding either the respectively ascertained overall errors G or the derivative values based thereon.

As a result, a plurality for a floor 20 or a floor 20 and a direction or a floor 20 and a direction before and after the floor can yield an average value for the overall error G, and the derivative value can be determined therefrom. To this end, for example, the elevator control system 16 can manage a so-called FIFO memory or the like for each derivative value, which stores a fixed number of overall errors G, e.g., eight overall errors, but also always stores at least the respectively current overall error, and the content of such a memory yields the average value, with the derivative value being formed based on this average value.

It can here also be provided that only those overall errors G be stored in the memory and taken into account when forming a derivative value that satisfy a prescribed or prescribable condition, for example that the overall error G must be less than a prescribed or prescribable threshold value, so that the overall error G can be considered when ascertaining a derivative value. For example, the threshold value can here be the standard deviation of previously acquired overall errors G.

Based hereupon, the elevator control system 16 can also generate information for in-stalling and/or maintaining the elevator system 10, for example a service signal, which

- codes whether the current trip was concluded with an overall error G within the tolerance range defined by the respective threshold value, i.e., whether it turns out based on the overall error G ascertained during the floor stop when leaving the floor that the landing precision during the preceding floor stop remained within the tolerance prescribed by the standard,
- codes the number of trips concluded with an overall error G within the tolerance range defined by the respective threshold value,
- codes the number of trips concluded outside an overall error G within the tolerance range defined by the respective threshold value,
- codes an average value for the overall error G, if necessary an average value for the floor-specific and/or direction-specific overall error G,
- codes a standard deviation in the overall error G, if necessary a standard deviation of the average value for the floor-specific and/or direction-specific overall error G, etc.

As a consequence, several paramount aspects of the specification submitted here can be briefly summarized as follows:

A method is indicated for operating an elevator control system 16 provided for controlling and monitoring the movements of at least one elevator car 14, wherein the elevator car 14 approaches separate floors 20 in a building under the control of the elevator control system 16, and in the process carries out a respective floor stop at a prescribed stopping position or prescribed stopping positions, and wherein an overall error G is ascertained in conjunction with the floor stop in the form of a deviation from an actual position of the elevator car 14 as well as a position of the elevator car 14 assumed as the current position. The ascertained overall error G describes the respective landing precision, and can be used to generate service signals and/or to improve the landing precision. For example, the elevator control system 16 accordingly generates a service signal or service signals based on a respective overall error G or a statistical acquisition of several values for an overall error G. Additionally or alternatively, the elevator control system 16 uses the overall error G to ascertain a derivative value, which is taken into account along with the current or stopping position during a comparison between the current position and stopping position performed by the elevator control system 16 for approaching the respective stopping position.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating an elevator control system for controlling and monitoring movements of at least one elevator car, wherein the at least one elevator car approaches individual floors in a building under control of the elevator control system and stops at a respective floor in a prescribed stopping position, the method comprising the steps of:

in conjunction with a floor stop of the at least one elevator car at one of the floors, determining an overall error as a deviation between an actual position of the at least one elevator car and a position of the at least one elevator car assumed as a current position; and generating from the elevator control system at least one service signal based on a statistical acquisition of a plurality of values of the overall error associated with a plurality of stops at the one floor.

2. The method according to claim 1 including using the overall error to ascertain a derivative value, and taking into account the derivative value along with the current position during a comparison between the current position and a stopping position performed by the elevator control system for approaching the one floor.

3. The method according to claim 2 including ascertaining the derivative value for each of the floors of the building based on the overall error for the respective floor.

4. The method according to claim 2 including ascertaining at least two derivative values based on respective ones of the overall error for the one floor being a first floor-specific derivative value for upward movement prior to the floor stop and a second floor-specific derivative value for downward movement prior to the floor stop.

5. The method according to claim 2 including ascertaining at least four derivative values based on the respective ones of the overall error for at least several of the floors being a first floor-specific derivative value for an upward movement prior to the floor stop and an upward movement after the floor stop, a second floor-specific derivative value for a downward movement prior to the floor stop and a downward movement after the floor stop, a third floor-specific derivative value for an upward movement prior to the floor stop and a downward movement after the floor stop, and a fourth floor-specific derivative value for a downward movement prior to the floor stop and an upward movement after the floor stop.

6. The method according to claim 2 wherein the elevator control system reads out the derivative value floor-specifically from a look-up table.

7. A digital storage medium with non-transitory electronically readable control signals that interact with the elevator control system to implement the method according to claim 1.

8. A control program product with program code means for performing the method according to claim 1 while the elevator control system executes the program code means with a processing unit of the elevator control system.

9. An elevator control system with a processing unit in which the control program product according to claim 8 is loaded for executing the program code means is executed by the processing unit during operation of the elevator control system.

* * * * *